US008534247B2

(12) United States Patent
Hori et al.

(10) Patent No.: US 8,534,247 B2
(45) Date of Patent: Sep. 17, 2013

(54) VALVE TIMING CONTROL APPARATUS

(75) Inventors: Akira Hori, Kariya (JP); Yoshiyuki Murao, Kariya (JP); Yasuhiro Hamaoka, Kariya (JP)

(73) Assignee: Denso Corporation, Kariya (JP)

( * ) Notice: Subject to any disclaimer, the term of this patent is extended or adjusted under 35 U.S.C. 154(b) by 100 days.

(21) Appl. No.: 13/364,545

(22) Filed: Feb. 2, 2012

(65) Prior Publication Data

US 2012/0199086 A1 Aug. 9, 2012

(30) Foreign Application Priority Data

Feb. 7, 2011 (JP) ..... 2011-24341

(51) Int. Cl.
*F01L 1/34* (2006.01)

(52) U.S. Cl.
USPC ..... 123/90.17; 335/220; 335/262

(58) Field of Classification Search
USPC ..... 123/90.15, 90.17, 90.6; 464/160, 464/161; 74/567, 568 R
See application file for complete search history.

(56) References Cited

U.S. PATENT DOCUMENTS

| | | | | |
|---|---|---|---|---|
| 7,209,020 | B2 * | 4/2007 | Telep | 335/255 |
| 8,136,790 | B2 * | 3/2012 | Hoppe et al. | 251/129.15 |
| 8,264,312 | B2 * | 9/2012 | Hamaoka et al. | 335/255 |
| 8,350,652 | B2 * | 1/2013 | Hoppe et al. | 335/262 |
| 8,427,263 | B2 * | 4/2013 | Hoppe et al. | 335/262 |
| 2004/0257185 | A1 | 12/2004 | Telep | |
| 2010/0313835 | A1 | 12/2010 | Yamaguchi et al. | |
| 2011/0248805 | A1 | 10/2011 | Hamaoka et al. | |

* cited by examiner

*Primary Examiner* — Thomas Denion
*Assistant Examiner* — Daniel Bernstein
(74) *Attorney, Agent, or Firm* — Nixon & Vanderhye PC

(57) ABSTRACT

A valve timing control apparatus includes a linear solenoid having a coil, a casing, a needle, a pair of cylindrical stators and a cylindrical spacer. The pair of cylindrical stators oppose with each other through an air gap in an axis direction. The pair of stators and the needle form a magnetic circuit so as to drive the needle to reciprocate. The cylindrical spacer fits with an outer circumference side of the pair of stators so as to restrict a short circuit from being generated in the magnetic circuit between the pair of stators. The spacer defines a discharge passage that connects the air gap to a discharge port of the casing.

10 Claims, 10 Drawing Sheets

VALVE TIMING CONTROL APPARATUS

CROSS REFERENCE TO RELATED APPLICATION

This application is based on Japanese Patent Application No. 2011-24341 filed on Feb. 7, 2011, the disclosure of which is incorporated herein by reference in its entirety.

BACKGROUND OF THE INVENTION

1. Field of the Invention

The present invention relates to a valve timing control apparatus for controlling a valve timing of a valve, which is opened and closed by a camshaft according to a torque transmitted from a crankshaft in an internal combustion engine.

2. Description of Related Art

Conventionally, a known valve timing control apparatus includes a housing, which is rotatable with rotation of a crankshaft, and a vane rotor, which is rotatable with rotation of a camshaft. JP-A-2010-285918 (US 2010/0313835 A1) describes a valve timing control apparatus in which a rotation phase of a vane rotor is changed toward advance side or retard side relative to a housing by introducing working fluid into an advance chamber or a retard chamber which are separated from each other in a rotation direction by the vane rotor in the housing. The valve timing control apparatus has a control valve and a linear solenoid. The control valve controls the flow of working fluid relative to the advance chamber and the retard chamber based on a reciprocation of a spool in a sleeve. An output shaft of the linear solenoid drives the spool of the control valve.

JP-A-2005-45217 (US 2004/0257185) discloses such a linear solenoid having a pair of cylindrical stators that oppose to each other through an air gap in an axis direction and a needle that reciprocates integrally with the output shaft. The pair of cylindrical stators and the needle are accommodated in an internal chamber of a casing. An energized coil generates a magnetic flux that passes through a magnetic circuit, and the pair of stators forms the magnetic circuit together with the needle, so that the needle reciprocates on the inner circumference side. As a result, the control valve controls the flow of working fluid relative to the advance chamber and the retard chamber based on the reciprocation of the spool. Thus, the valve timing is controlled by the change of the rotation phase.

In a case where the linear solenoid is applied to the valve timing control apparatus, when the working fluid passes through the sleeve open to the linear solenoid, a part of the working fluid flows into the internal chamber of the casing from a bearing clearance of the output shaft, for example. In this case, if a foreign object such as metal powder having magnetic property (hereinafter referred as magnetic object) is contained in the working fluid, the magnetic object may stay in the air gap between the pair of stators, so that unnecessary short circuit may be generated in the magnetic circuit.

As shown in FIG. 14 of JP-A-2005-45217, the linear solenoid has a cylindrical coil bobbin that fits with an outer circumference side of the pair of stators in the internal chamber of the casing, so that the short circuit may be restricted from being generated. However, because the air gap is surrounded by the bobbin from the outer circumference side, the air gap has no outlet for the magnetic object. If the magnetic objects stays in the air gap, the function of restricting the short circuit is lowered. The short circuit causes a lowering in the responsivity of the spool that is driven by the output shaft, so that the responsivity of the valve timing control may be lowered.

SUMMARY OF THE INVENTION

According to one aspect of the present invention, a valve timing control apparatus for controlling a valve timing of a valve configured to be opened and closed by a camshaft in accordance with a torque transmitted from a crankshaft of an internal combustion engine includes a housing, a vane rotor, a control valve, and a linear solenoid. The housing is rotatable with the crankshaft. The vane rotor is rotatable with the camshaft, and partitions an interior of the housing into an advance chamber and a retard chamber in a rotative direction. The vane rotor is configured to change a rotation phase relative to the housing to an advance side or a retard side correspondingly when working fluid is supplied into the advance chamber or the retard chamber. The control valve controls a flow of the working fluid relative to the advance chamber and the retard chamber through a spool that is linearly movable in a sleeve through which the working fluid passes, and is arranged in a gang rotating element constructed by the vane rotor and the camshaft. The linear solenoid has an output shaft that linearly reciprocates the spool, a coil, a casing, a needle, a pair of cylindrical stators, and a cylindrical spacer. The coil generates a magnetic flux by being supplied with electricity. The casing defines an internal chamber into which the working fluid flows from the sleeve, and a discharge port from which the working fluid is discharged out of the internal chamber. The needle reciprocates integrally with the output shaft in the internal chamber. The pair of cylindrical stators oppose with each other through an air gap in an axis direction in the internal chamber. The pair of stators and the needle form a magnetic circuit through which the magnetic flux passes so as to drive the needle to reciprocate on an inner circumference side of the pair of stators. The cylindrical spacer fits with an outer circumference side of the pair of stators in the internal chamber so as to restrict a short circuit from being generated in the magnetic circuit between the pair of stators. The air gap is located on an inner circumference side of the spacer. The spacer defines a discharge passage that connects the air gap to the discharge port of the casing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION (Embodiment)

Figure 1:
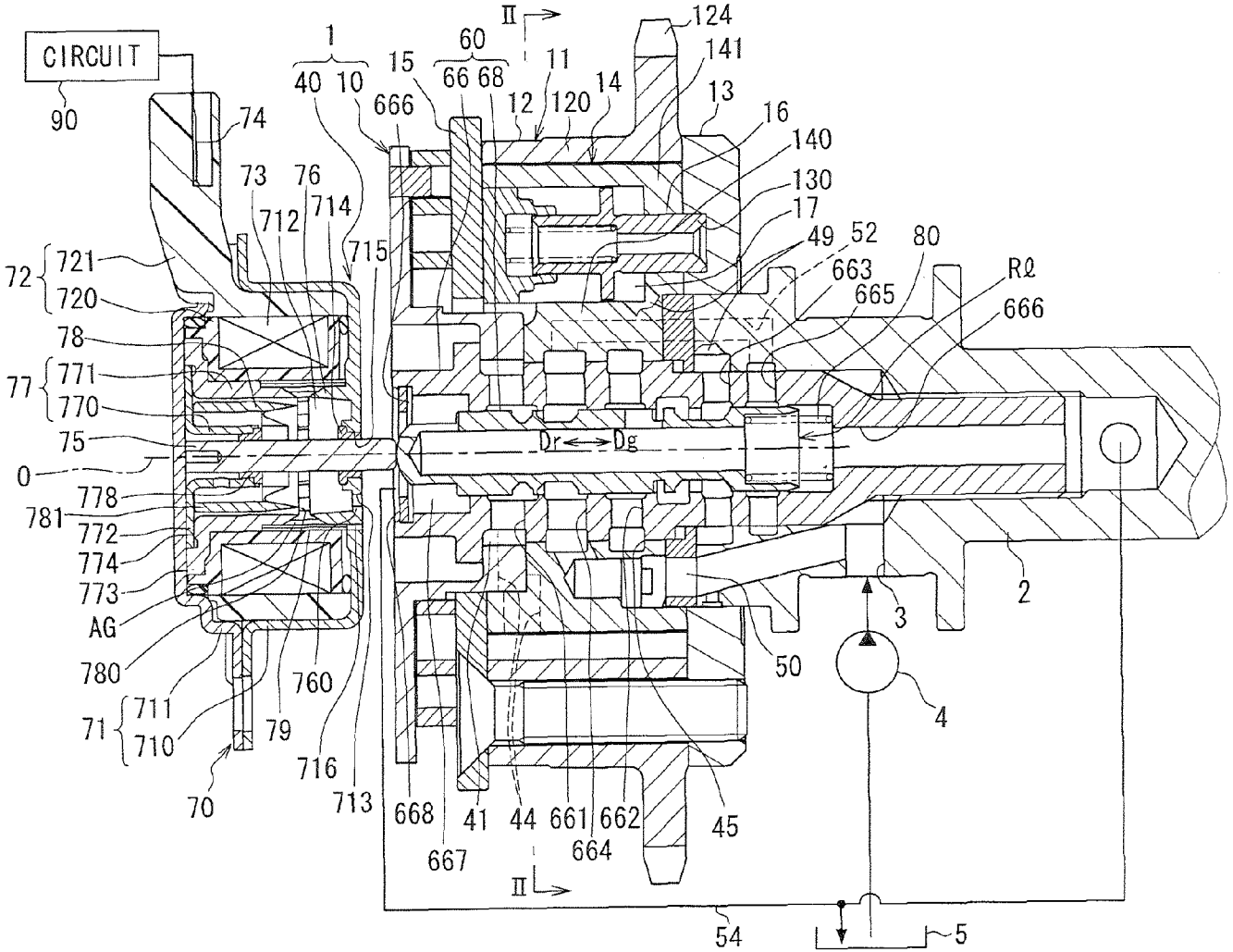
FIG. 1 is a sectional view illustrating a valve timing control apparatus according to an embodiment.

FIG. 1 shows an example of a valve timing control apparatus 1 according to an embodiment, which is applied to an internal combustion engine of a vehicle. The valve timing control apparatus 1 controls a valve timing of an intake valve by using a working fluid such as oil.

(Basic Construction)

The valve timing control apparatus 1 includes an actuator portion 10 and a control portion 40. The actuator portion 10 is provided to a transmission system, which transmits engine torque from a crankshaft (not shown) to a camshaft 2, and driven by the working fluid. The control portion 40 controls supply of the working fluid to the actuator portion 10.

(Actuator Portion)

Figure 2:
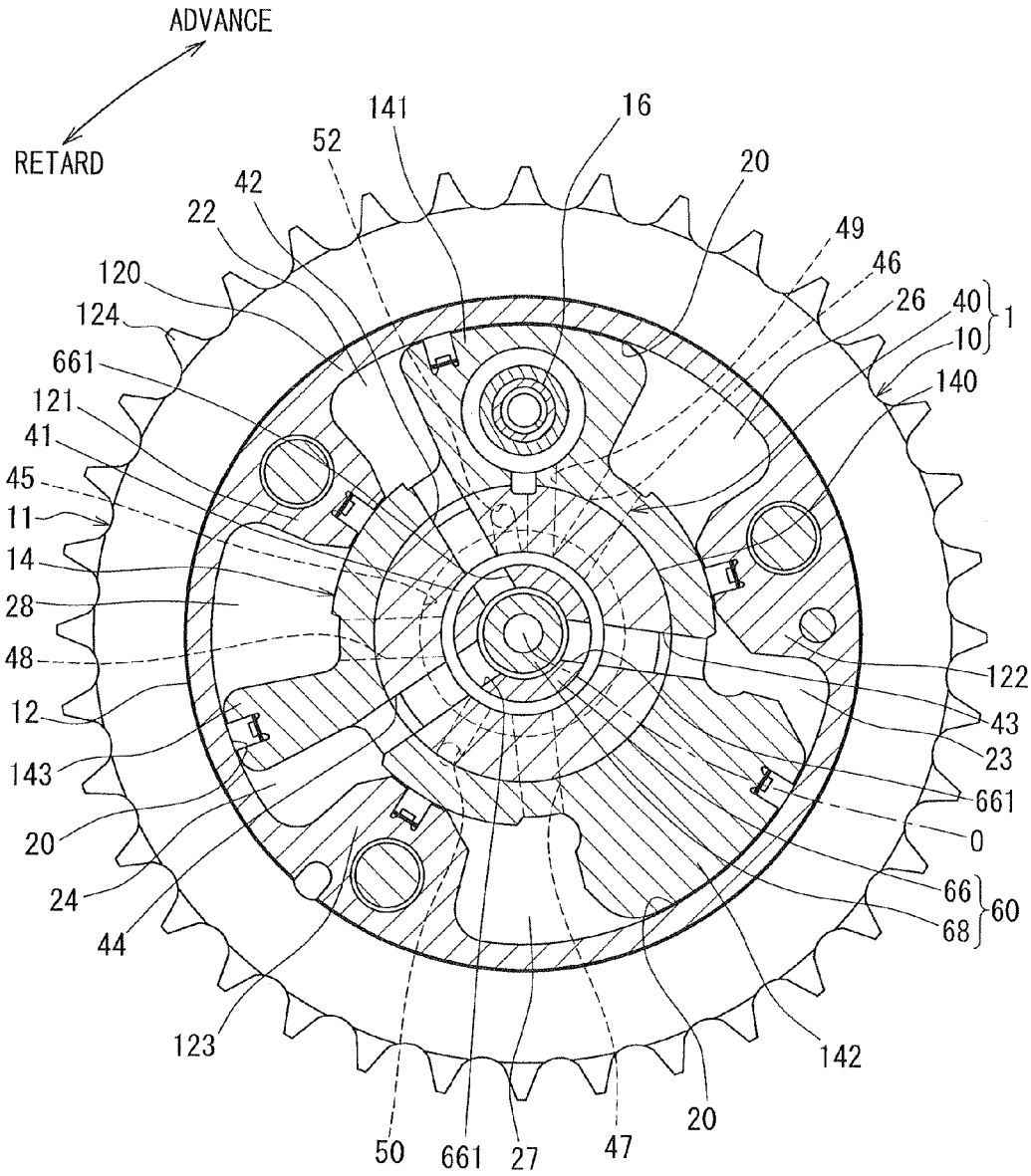
FIG. 2 is a sectional view taken along a line II-II in FIG. 1.

In the actuator portion 10, a metallic housing 11 has a shoe ring 12, and a rear plate 13 and a front plate 15 are coupled to ends of the ring 12, respectively, in the axis direction. The shoe ring 12 includes a tubular housing body 120, multiple shoes 121, 122, 123 and a sprocket 124. The shoes 121, 122, 123 function as partitioning parts. The shoes 121, 122, 123 are projected to the radially inner side from portions of the housing body 120. The portions of the shoes 121, 122, 123 are spaced by a prescribed distance in a rotation direction of the housing body 120. The shoes 121, 122, 123, which are adjacent to each other in the rotation direction, form an accommodation chamber 20 therebetween. The sprocket 124 is connected with the crankshaft via a timing chain (not shown). According to the present structure, engine torque is transmitted from the crankshaft to the sprocket 124 during an operation of the internal combustion engine. Thereby, the housing 11 rotates in the clockwise rotation of FIG. 2 with rotation of the crankshaft.

A metallic vane rotor 14 is accommodated coaxially in the housing 11, and is slidably in contact with the rear plate 13 and the front plate 15 at both sides in the axial direction. The vane rotor 14 includes a tubular rotation axis 140 and vanes 141, 142, 143. The rotation axis 140 is coaxially fixed to the camshaft 2. In the present structure, the vane rotor 14 is rotatable in the clockwise rotation of FIG. 2 with rotation of the camshaft 2. In addition, the vane rotor 14 is rotatable relative to the housing 11.

The vanes 141, 142, 143 project radially outward from portions of the rotation axis 140. The portions of the rotation axis 140 are spaced by a prescribed distance in the rotation direction. The vanes 141, 142, 143 are respectively accommodated in corresponding accommodation chambers 20.

The vanes 141, 142, 143 respectively partition the accommodation chambers 20 correspondingly to form advance chambers 22, 23, 24 and retard chambers 26, 27, 28 in the housing 11. An advance chamber 22 is formed between the shoe 121 and the vane 141. An advance chamber 23 is formed between the shoe 122 and the vane 142. An advance chamber 24 is formed between the shoe 123 and the vane 143. A retard chamber 26 is formed between the shoe 122 and the vane 141. A retard chamber 27 is formed between the shoe 123 and the vane 142. A retard chamber 28 is formed between the shoe 121 and the vane 143.

The vane 141 accommodates a lock member 16 to be fitted with a lock hole 130 of the front plate 13 so as to lock the rotation phase of the vane rotor 14 relative to the housing 11. Further, the vane 141 has an unlock chamber 17 into which the working oil is introduced to unlock the rotation phase by separating the lock member 16 from the lock hole 130.

In a state that the rotation phase is unlocked by the lock member 16, if working fluid is introduced into the advance chamber 22, 23, 24 and is discharged from the retard chamber 26, 27, 28, the rotation phase is advanced, so that the valve timing is advanced. In contrast, if working fluid is introduced into the retard chamber 26, 27, 28, and is discharged from the advance chamber 22, 23, 24, the rotation phase is retarded, so that the valve timing is retarded.

(Control Portion)

In the control portion 40, an advance main passage 41 is formed along the inner circumferential periphery of the rotation axis 140. Advance branch passages 42, 43, 44 extend through the rotation axis 140. The advance branch passages 42, 43, 44 respectively communicate with the corresponding advance chambers 22, 23, 24 and the common advance main passage 41.

A retard main passage 45 is defined by an annular groove opened in the inner circumferential periphery of the rotation axis 140. Retard branch passages 46, 47, 48 extend through the rotation axis 140 and respectively communicate with the corresponding retard chambers 26, 27, 28 and the common retard main passage 45. An unlock passage 49 extends through the rotation axis 140 and communicates with the lock chamber 17.

A main supply passage 50 extends through the rotation axis 140. The main supply passage 50 communicates with a pump 4, which functions as a supply source, through a conveyance passage 3 of the camshaft 2. The pump 4 is a mechanical pump driven by the crankshaft with a driving operation of the internal combustion engine. During the engine operation, the pump 4 regularly discharges working fluid drawn from a drain pan 5. The conveyance passage 3 is always communicating with a discharge port of the pump 4 irrespective to the rotation of the camshaft 2, thereby working oil is regularly sent from the pump 4 toward the main supply passage 50 during the engine operation.

A sub-supply passage 52 extends through the rotation axis 140, and is branched from the main supply passage 50. The passage 52 receives working oil supplied from the pump 4 through the main supply passage 50.

A drain collection passage 54 is defined outside of the actuating portion 10 and the camshaft 2. The passage 54 is exposed to atmospheric air with the drain pan 5 corresponding to a drain collector, and the working oil is dischargeable from the passage 54 to the pan 5.

A control valve 60 is a spool valve to reciprocate a spool 68 in a sleeve 66 in the axis direction using an elastic biasing force generated by a biasing member 80 and a driving force generated by energizing a linear solenoid 70. The elastic biasing force and the driving force are applied in opposite directions in the axis direction. The control valve 60 and the biasing member 80 are coaxially arranged in a gang rotating element 2, 14 constructed by the camshaft 2 and the vane rotor 14, so that the control valve 60 and the biasing member 80 rotate together with the gang rotating element 2, 14.

Specifically, the control valve 60 is defined in a manner that the metallic spool 68 is slidably accommodated in the metallic sleeve 66. The sleeve 66 has an advance port 661, a retard port 662, an unlock port 663, a main supply port 664, a sub-supply port 665, and a drain port 666.

The advance port 661 communicates with the advance main passage 41. The retard port 662 communicates with the retard main passage 45. The unlock port 663 communicates with the unlock passage 49.

Figure 3:
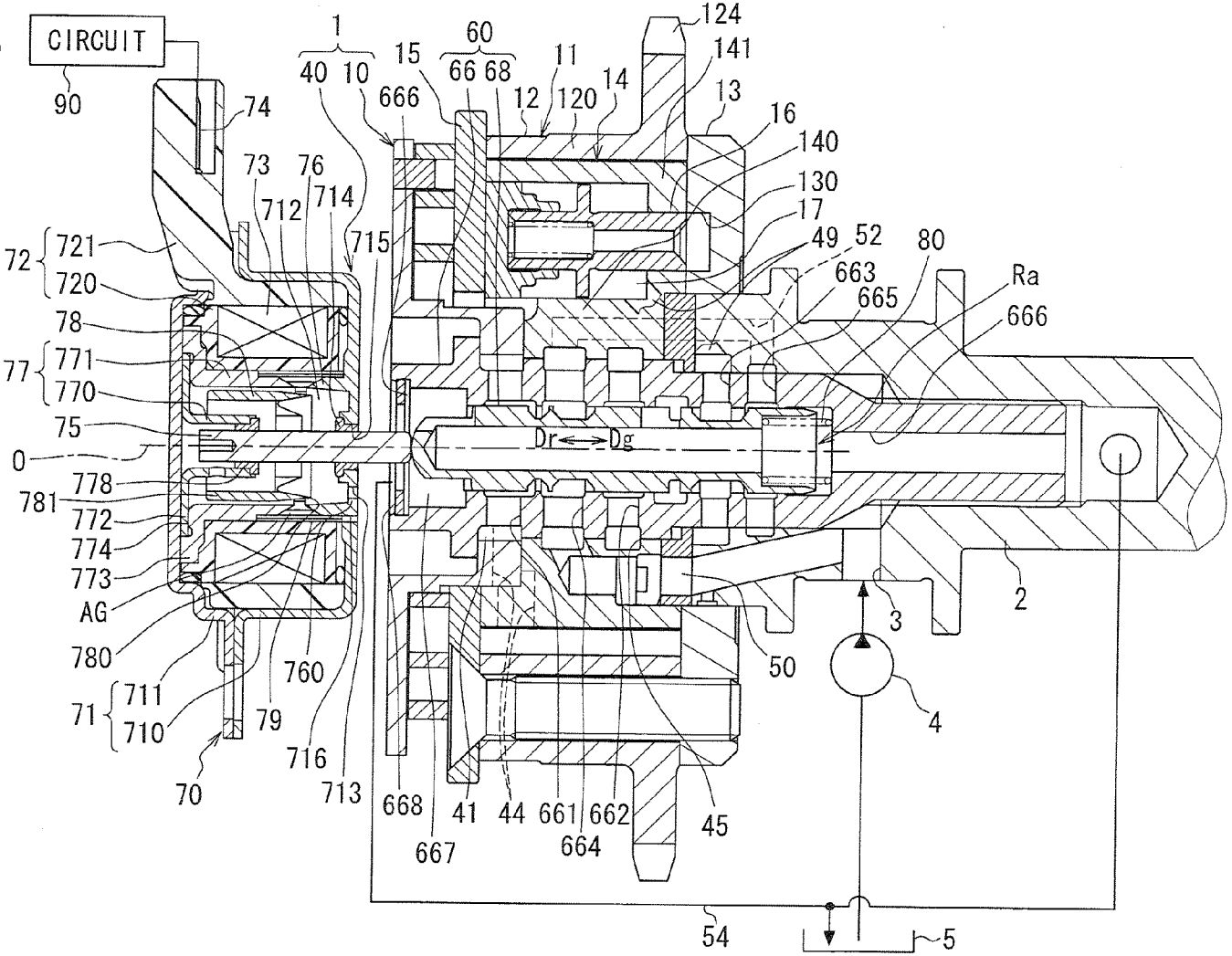
FIG. 3 is a sectional view illustrating an operational state of the valve timing control apparatus.
Figure 4:
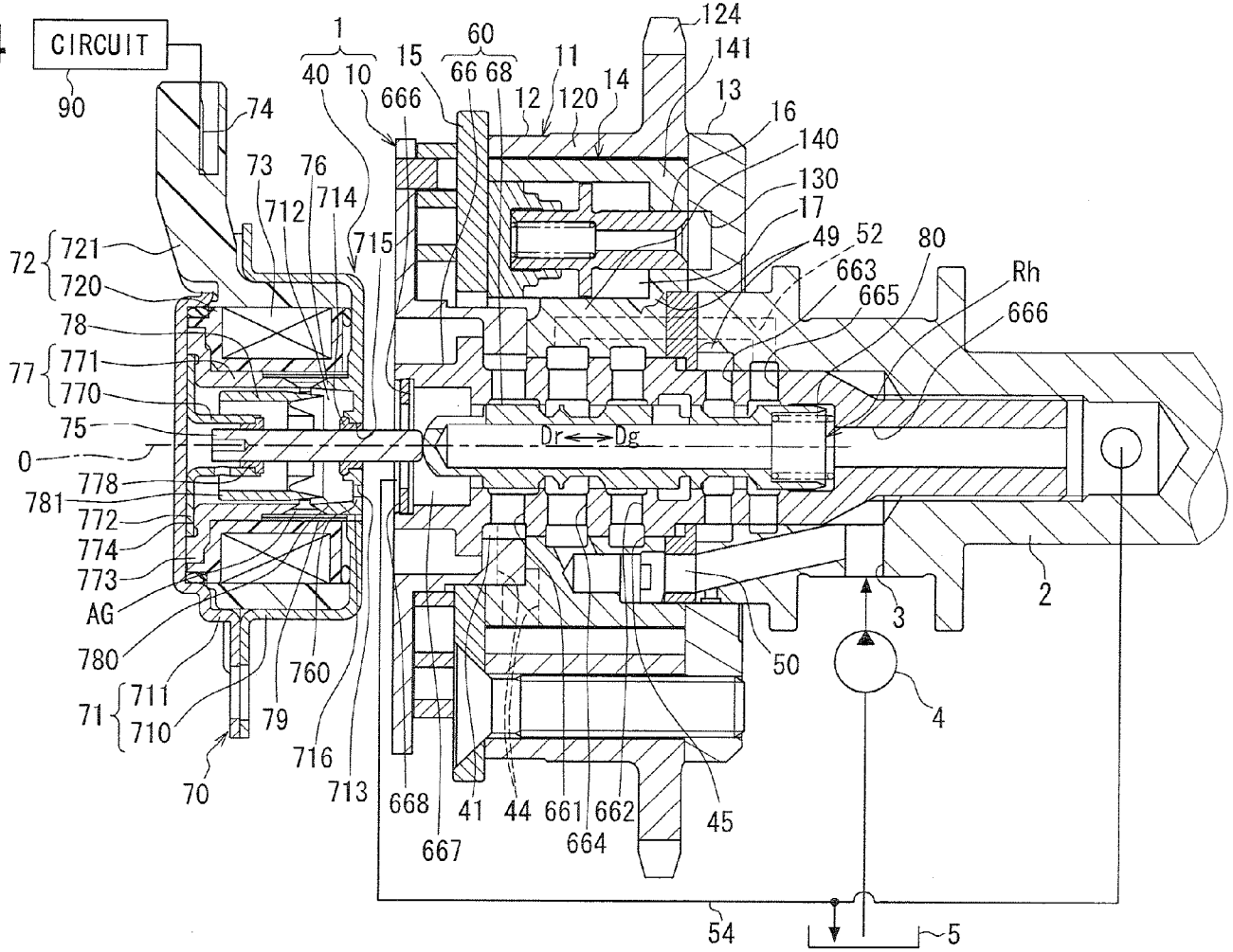
FIG. 4 is a sectional view illustrating an operational state of the valve timing control apparatus.
Figure 5:
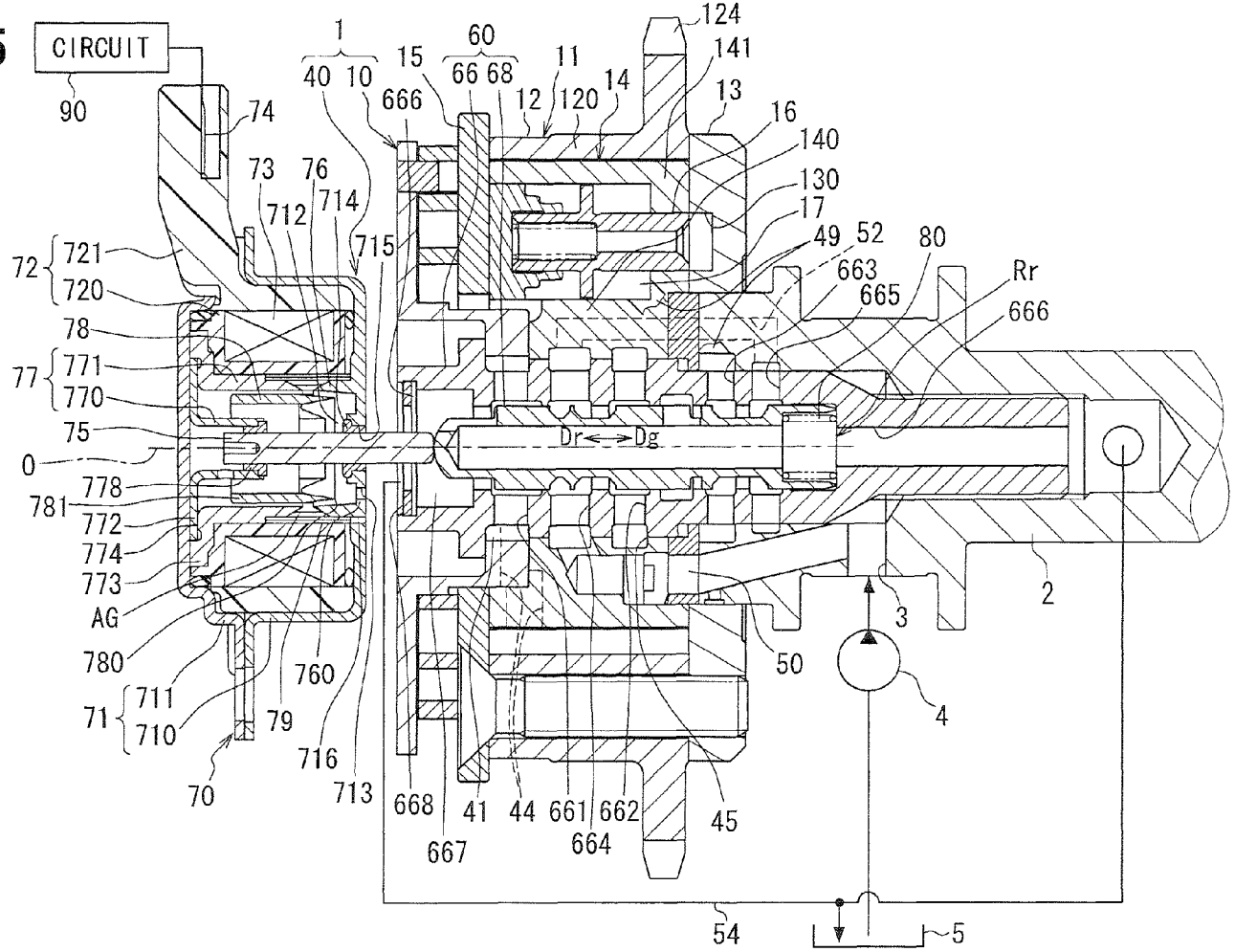
FIG. 5 is a sectional view illustrating an operational state of the valve timing control apparatus.

The main supply port 664 communicates with the main supply passage 50. The sub-supply port 665 communicates with the sub-supply passage 52. The pair of the drain port 666 communicates with the drain collection passage 54. The control valve 60 switches the connection state among the ports 661, 662, 663, 664, 665, 666 based on a variation in the position of the spool 68, as shown in FIGS. 1, 3, 4 and 5, thereby controlling the flow of working oil relative to the chamber 17, 22, 23, 24, 26, 27, 28. FIG. 1 shows the spool 68 located in a rock region Rl. FIG. 3 shows the spool 68 located in an advance region Ra. FIG. 4 shows the spool 68 located in a holding region Rh. FIG. 5 shows the spool 68 located in a retard region Rr.

When the spool 68 is positioned in the lock region Rl, as shown in FIG. 1, the advance port 661 is connected to the main supply port 664. At this time, the working oil supplied from the pump 4 is throttled and introduced into the advance chamber 22, 23, 24. Further, the retard port 662 and the unlock port 663 are connected to the drain port 666. At this time, the working oil of the chamber 26, 27, 28, 17 is discharged into the drain pan 5. Thus, in the rock region Rl, small amount of the working oil is introduced into the advance chamber 22, 23, 24 and the working oil is discharged from the retard chamber 26, 27, 28 and the unlock chamber 17, so that the rotation phase is locked.

When the spool 68 is positioned in the advance region Ra, as shown in FIG. 3, the advance port 661 is connected with the main supply port 664, and the lock activation port 663 is connected to the sub-supply port 665. At this time, the working oil supplied from the pump 4 is introduced into the advance chamber 22, 23, 24 and the unlock chamber 17. Further, the retard port 662 is connected to the drain port 666. At this time, the working oil of the retard chamber 26, 27, 28 is discharged into the drain pan 5. Thus, in the advance region Ra, the working oil is introduced into the advance chamber 22, 23, 24 and the working oil is discharged from the retard chamber 26, 27, 28 under the situation that rotation phase is unlocked, so that the rotation phase is advanced and that the valve timing is advanced.

When the spool 68 is positioned in the holding region Rh, as shown in FIG. 4, the advance port 661 and the retard port 662 are disconnected from any other port. At this time, the working oil can be held in the advance chamber 22, 23, 24 and the retard chamber 26, 27, 28. Further, the lock activation port 663 is connected to the sub-supply port 665. At this time, the working oil supplied from the pump 4 is introduced into the lock chamber 17. Thus, in the holding region Rh, the working oil stays in the advance chamber 22, 23, 24 and the retard chamber 26, 27, 28 under the situation that rotation phase is unlocked, so that the valve timing is held in a variation range of the rotation phase caused by a fluctuating torque.

When the spool 68 is positioned in the retard region Rr, as shown in FIG. 5, the retard port 662 is connected to the main supply port 664, and the unlock port 663 is connected to the sub-supply port 665. At this time, the working oil supplied from the pump 4 is introduced into the retard chamber 26, 27, 28 and the unlock chamber 17. Further, the advance port 661 is connected with the drain port 666. At this time, the working oil of the advance chamber 22, 23, 24 is discharged into the drain pan 5. Thus, in the retard region Rr, the working oil is discharged from the advance chamber 22, 23, 24 and the working oil is introduced into the retard chamber 26, 27, 28 under the situation that rotation phase is unlocked, so that the rotation phase is retarded and that the valve timing is retarded.

In the control valve 60, the working oil passes through an internal space 667 of the sleeve 66. Therefore, especially in the region Rl, Ra, Rr in which the working oil passes through the drain port 666, the working oil discharged into the drain collection passage 54 located outside is introduced into the drain pan 5 from an opening 668 of the sleeve 66. The opening 668 forms the drain port 666 located adjacent to the linear solenoid 70, and communicates with the internal space 667.

A control circuit 90 shown in FIG. 1 is an electronic control device including, for example, a microcomputer and the like. The control circuit 90 is electrically connected with the solenoid 70 and devices (not shown) of the engine. The control circuit 90 controls energization of the solenoid 70 based on a program memorized in an internal memory. In addition, the control circuit 90 controls a driving operation of the internal combustion engine.

(Linear Solenoid)

The linear solenoid 70 will be described with reference to FIGS. 1, 6 and 7 in which a left-and-right direction corresponds to a horizontal direction of a vehicle disposed on a horizontal surface, and an up-and-down direction corresponds to a vertical direction of the vehicle.

As shown in FIG. 1, the flat type linear solenoid 70 has a casing 71, a mold case 72, a coil 73, a terminal 74, an output shaft 75, a pair of stators 76, 77, a needle 78, and a spacer 79.

The casing 71 is constructed by a pair of cups 710, 711 made of magnetic material such as steel, and has a hollow shape defining an internal chamber 712. The casing 71 is fixed to a fix part of the engine such as a chain case, and is always kept in the fixed state relative to the rotation of the control valve 60 integrated with the camshaft 2 and the vane rotor 14.

As shown in FIG. 1, the based cylindrical front cup 710 is arranged in a manner that the center of the bottom of the cup 710 coaxially opposes to the opening 668 of the sleeve 66 of the control valve 60, from which the working oil is discharged from the internal space 667. The center of the bottom of the front cup 710 has an aspiration hole 713 and a bearing hole 715. The internal chamber 712 is opened to atmospheric air through the hole 713. The output shaft 75 is supported by the bearing hole 715 through a bearing bush 714. The bottom of the front cup 710 has a discharge port 716 from which the working oil of the internal chamber 712 is discharge outside of the casing 71. The discharge port 716 is distanced from the opening 668.

The mold case 72 is made of nonmagnetic resin, and is arranged to pass between the cups 710, 711, so as to be located astride the inside and outside of the casing 71. The mold case 72 has a bobbin 720 and a connector 721. The bobbin 720 is accommodated in the internal chamber 712 of the casing 71, and includes the coil 73. The connector 721 protrudes outside of the casing 71, and covers the terminal 74.

The coil 73 has a cylindrical shape as a whole, and a metal wiring is would around the coil 73. The coil 73 is coaxially arranged in each of the cups 710, 711 of the casing 71. The metal wiring constructing the coil 73 is electrically connected with the control circuit 90 through the metal terminal 74. Thereby, the coil 73 generates a flux of magnetic by being magnetized with electricity supplied from the control circuit 90.

As shown in FIG. 1, the metallic output shaft 75 is shaped in a pillar stick, and penetrates the front cup 710 of the casing 71 through an inner circumference side of the bearing hole 715. Outside of the casing 71, the output shaft 75 coaxially contacts the spool 68 of the control valve 60 in view of the recovering force of the elastic member 80, so that the spool 68 is reciprocable in both first and second directions Dg, Dr in the axis direction.

The front stator 76 is made of magnetic material such as steel, and is formed into a based cylindrical shape integrally with the front cup 710 of the casing 71. In the internal chamber 712 of the casing 71, the front stator 76 is coaxially arranged on the outer circumference side of the output shaft 75 and on the inner circumference side of the bobbin 720. According to this arrangement, the center of the bottom of the front cup 710 opposing to the opening 668 of the sleeve 66 works as a bottom 760 of the front stator 76.

Figure 6:
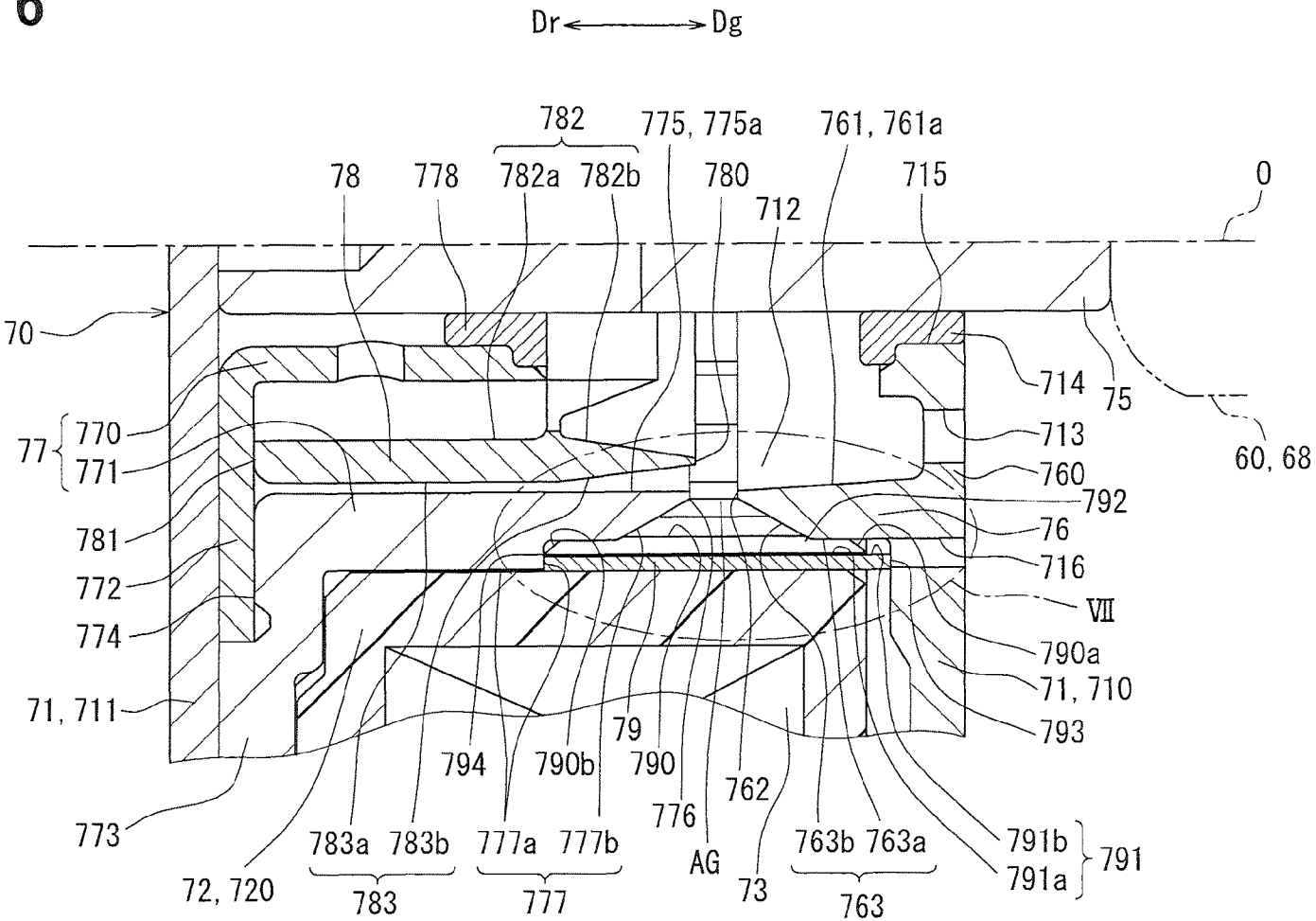
FIG. 6 is an enlarged sectional view illustrating a linear solenoid of the valve timing control apparatus.

As shown in FIG. 6, an inner circumference face 761 of the front stator 76 has an inner circumference tapered part 761*a* which inclines outward as approaching to a tip end 762 of the stator 76 from the bottom 760 in the axis direction. Moreover, an outer circumference face 763 of the front stator 76 has a straight part 763*a* straightly extended from the bottom 760, and a tapered part 763*b* which inclines inward as approaching to the tip end 762 from the straight part 763*a*. Therefore, a thickness of the front stator 76 in the radial direction becomes thin as approaching to the tip end 762 in a portion of the stator 76 forming the tapered part 761*a*, 763*b* on the both sides in the radial direction.

As shown in FIG. 1, the rear stator 77 has a double cylindrical shape constructed by a pair of pipe components 770, 771 made of magnetic material such as steel, and is coaxially arranged in the internal chamber 712 of the casing 71 on the outer circumference side of the output shaft 75 and on the inner circumference side of the bobbin 720.

As shown in FIG. 6, the pipe component 770, 771 has a cylinder shape with a flange part 772, 773 that is in face contact with the bottom of the rear cup 711. Moreover, the flange part 773 of the external pipe component 771 has a concave 774 on the inner circumference side, and the concave 774 fits to the flange part 772 of the internal pipe component 770, so that the pipe components 770, 771 are magnetically connected with each other.

As shown in FIG. 6, an inner circumference face 775 of the external pipe component 771 has an inner circumference straight part 775*a* straightly extended from the flange part 773 to a tip end 776 of the external pipe component 771 in the axis direction. Further, an outer circumference face 777 of the external pipe component 771 has a step part 777*a* and a tapered part 777*b*. The step part 777*a* is extended from the flange part 773, and a diameter of the step part 777*a* is reduced compared with that of a flat part. The tapered part 777*b* inclines inward as approaching from the step part 777 to the tip end 776. Therefore, a thickness of the external pipe component 771 in the radial direction becomes thin as approaching to the tip end 776 in a portion of the external pipe component 771 forming the straight part 775*a* and the tapered part 777*b* on the both sides in the radial direction.

Figure 7:
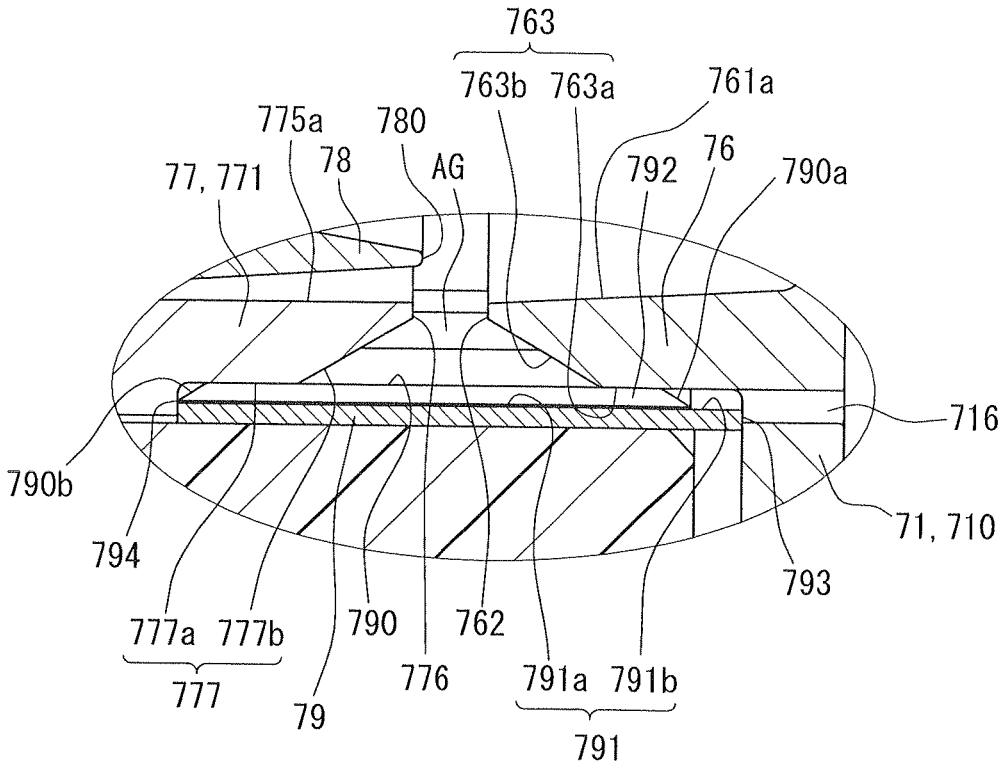
FIG. 7 is an enlarged sectional view of a relevant portion VII in FIG. 6.

As shown in FIGS. 6 and 7, the straight part 775*a* has a constant internal diameter, and an inner diameter of the tip end 776 of the external pipe component 771 is coincident with the inner diameter of the straight part 775*a*. An inner diameter of the tip end 762 of the front stator 76 is coincident with the minimum inner diameter of the tapered part 761*a*. The inner diameter of the tip end 776 is set approximately the same as the inner diameter of the tip end 762.

Moreover, the maximum outer diameter of the tapered part 777*b* of the external pipe component 771 is set approximately the same as the maximum outer diameter of the tapered part 763*b* of the front stator 76. Thus, the rear stator 77 and the front stator 76 oppose with each other in a state where the air gap AG that continues around the common axis line O is defined between the tip ends 776, 762 and between the tapered parts 777*b*, 763*b*, in the axis direction.

As shown in FIG. 1, the cylindrical needle 78 is made of magnetic material such as steel, and is arranged in the internal chamber 712 of the casing 71 in the state that the needle 78 is coaxially fitted and fixed to the outer circumference side of the output shaft 75. In this embodiment, the output shaft 75 is supported by the internal pipe component 770 of the rear stator 77 through a bearing bush 778, so that the needle 78 is also supported by the internal pipe component 770. Therefore, as shown in FIGS. 1, 3, 4, and 5, the needle 78 is linearly movable together with the output shaft 75 on the inner circumference side of the external pipe component 771 of the rear stator 77, on the inner circumference side of the air gap AG, and on the inner circumference side of the front stator 76.

As shown in FIG. 6, an inner circumference face 782 of the needle 78 has an inner circumference straight part 782*a* straightly extended from a rear end part 781, and an inner circumference tapered part 782*b* that inclines outward as approaching to a tip end 780 of the needle 78 from the straight part 782*a* in the axis direction. Further, an outer circumference face 783 of the needle 78 has an outer circumference straight part 783*a* straightly extended from the rear end part 781, and an outer circumference tapered part 783*b* that inclines inward as approaching to the tip end 780 of the needle 78 from the straight part 783*a* in the axis direction. Therefore, a thickness of the needle 78 in the radial direction becomes thin as approaching to the tip end 780 in a portion of the needle 78 forming the tapered part 782*b*, 783*b* on the both sides in the radial direction.

The needle 78 forms the magnetic circuit through which the magnetic flux generated by the coil 73 passes together with the pair of stators 76, 77, so that the needle 78 is reciprocated in the both directions Dg, Dr in the axis direction. Especially when the magnetic flux has the maximum density due to the maximum current supplying, the needle 78 makes the spool 68 to contact the sleeve 66 through the output shaft 75, as shown in FIG. 5, so that the needle 78 is restricted from moving in the first direction Dg. In contrast, when the magnetic flux disappears due to the stop of the current supplying for the coil 73, the rear end portion 781 of the needle 78 contacts the flange part 772 of the rear stator 77 in a state that the tip end 780 is located on the outer circumference side of the air gap AG, as shown in FIGS. 1, 6 and 7, so that the needle 78 is restricted from moving in the second direction Dr.

As shown in FIG. 1, the cylindrical spacer 79 made of nonmagnetic material is coaxially arranged in the internal chamber 712 of the casing 71 on the outer circumference side of the pair of stators 76, 77 and on the inner circumference side of the bobbin 720. The center axis line O which is common for the spacer 79, the stators 76, 77, (the camshaft 2, the vane rotor 14, and the control valve 60) approximately corresponds to the horizontal direction of the vehicle located on the horizontal surface.

As shown in FIG. 6, an inner circumference face 790 of the spacer 79 has a tapered part 790*a*, 790*b* which inclines outward as approaching an end portion 793, 794 of the spacer 79 in the axis direction. Further, the inner circumference face 790 is coaxially press-fitted with the straight part 763*a* of the outer circumference face 763 of the front stator 76 and the step part 777*a* of the outer circumference face 777 of the external pipe component 771 of the rear stator 77. Thus, the spacer 79 raises the coaxial accuracy between the stators 76, 77, and restricts the magnetic flux generated by the coil 73 from directly forming a short circuit in the air gap AG between the stators 76, 77.

Figure 8A:
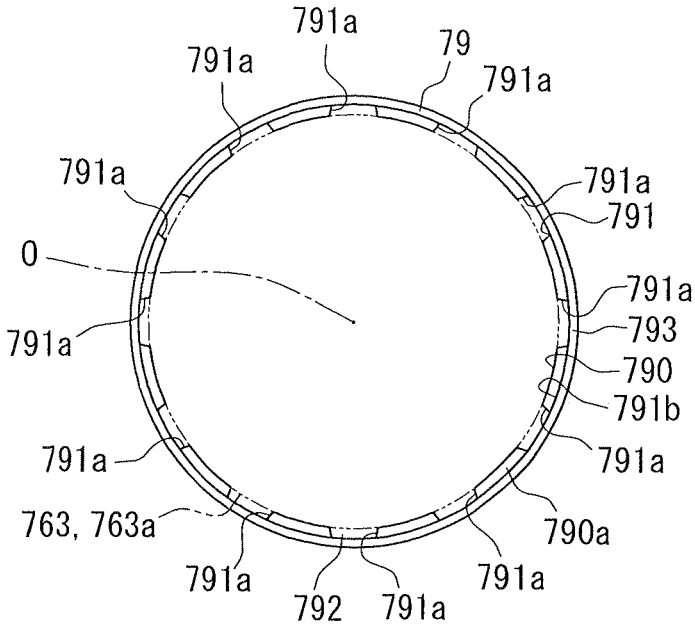
FIG. 8A is a side view illustrating a spacer of the linear solenoid.
Figure 8B:
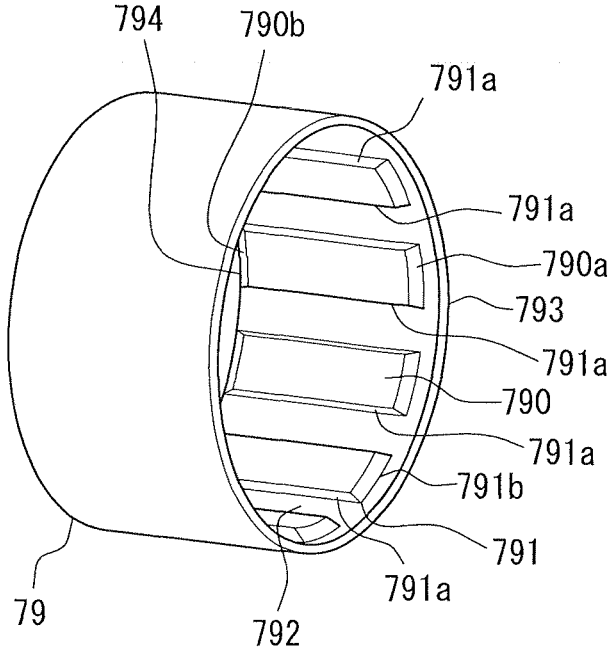
FIG. 8B is a perspective view illustrating the spacer.

Moreover, the spacer 79 defines a discharge passage 792 that connects the air gap AG to the discharge port 716 of the casing 71. The discharge passage 792 is constructed by a discharge groove 791 defined on the inner circumference face 790, and a part of the groove 791 is covered with the stator 76, 77. As shown in FIG. 8B, the groove 791 has three or more (for example, twelve in FIG. 8A) axial grooves 791*a* and one circumferential groove 791*b*. The axial grooves 791*a* are located over most area of the spacer 79 except the end portion 793 opposing to the front stator 76, and are arranged with constant intervals around the center axis line O. The axial groove 791*a* extends in the axis direction along the center axis line O, and communicates with the air gap AG through an aperture not covered with the stator 76, 77. The axial groove 791*a* extends in both sides in the axis direction from the outer circumference side of the air gap AG including the lower part of the air gap AG. Further, in the end portion 793 of the spacer 79 opposing to the discharge port 716, the circumferential groove 791*b* extends in the circumferential direction around the center axis line O, and connects the axial grooves 791*a* with each other. Therefore, the circumferential groove 791*b* communicates with the axial grooves 791 and the discharge port 716 in the axis direction.

When the coil 73 is not energized, as shown in FIGS. 1 and 6, the needle 79 receives the biasing force of the elastic member 80 through the spool 68 and the output shaft 75, so that the rear end portion 781 contacts the flange part 772 of the rear stator 77. Therefore, the needle 78 and the output shaft 75 are restricted from moving in the second direction Dr, and the spool 68 is positioned in the lock region Rl. At this time, the tip end 780 of the needle 78 is positioned on the outer circumference side of the air gap AG.

When energization of the coil 73 is started, the magnetic flux generated by the coil 73 passes from the flange part 772 of the rear stator 77, and flows from the end portion 781 to the end portion 780 in the needle 78. Further, the magnetic flux passes through the front stator 76 from the tip end 762 to the bottom 760, so as to form the magnetic circuit. Therefore, the needle 78 is driven in the first direction Dg against the elastic force of the biasing member 80, and the output shaft 75 integrated with the needle 78 drives the spool 68 in the first direction Dg. As a result, the rear end portion 781 of the needle 78 is separated from the rear cup 711. The magnetic flux generated by the coil 73 passes from the tip end 776 of the rear stator 77 toward the tip end 780 of the needle 78, further, passes through the front stator 76 toward the bottom 760, so as to form the magnetic circuit. As the current supplied to the coil 73 is increased, as shown in FIGS. 3, 4 and 5, the needle 78 is moved in the first direction Dg, so that the spool 68 is moved among the regions Ra, Rh, Rr in accordance with the movement of the needle 78.

The working oil easily flows into the internal chamber 712 of the casing 71 from the sleeve 66 through the opening 668 of the sleeve 66 and the aspiration hole 713 of the casing 71. The spacer 79 fitted to the outer circumference side of the stators 76, 77 restricts a direct short circuit from being generated in the air gap AG between the stators 76, 77 in the internal chamber 712. The spacer 79 is located to surround the air gap AG from the outer circumference side. When a magnetic foreign object such as metal powder is generated by a sliding between the housing 11 and the vane rotor 14 or a sliding between the sleeve 66 and the spool 68, and when the magnetic foreign object is contained in the working oil, the magnetic foreign object may stay or accumulate in the air gap AG so as to form an unnecessary magnetic short circuit.

According to the embodiment, the axial groove 791*a* is partially covered with the stators 76, 77, and the circumferential groove 791*b* is entirely covered with the stators 76, 77, in the internal chamber 712. Therefore, the discharge passage 792 is securely formed by the discharge groove 791, and connects the air gap AG to the discharge port 716 of the casing 71. The magnetic foreign object flows into the discharge passage 792 from the air gap AG together with the working oil, so that the magnetic foreign object is discharged out of the casing 71 through the port 716.

At least one of the axial grooves 791*a*, for example shown in FIGS. 6 and 7, is located under the air gap AG on the outer circumference side, and the magnetic foreign object easily drops into the at least one of the axial grooves 791*a* due to the gravity force. Further, the magnetic foreign object entering the axial groove 791*a* is guided by the working oil in the axis direction in which the groove 791*a* extends in the spacer 79. Thereby, the object is discharged from the port 716 communicating with the axial groove 791*a* through the circumferential groove 791*b*. Thus, the object can be restricted from staying in the air gap AG.

The inner circumference tapered part 761*a* of the front stator 76 inclines outward as approaching the tip end 762 adjacent to the air gap AG. Due to the tapered part 761*a*, the working oil can smoothly flow toward the air gap AG. Therefore, the object can easily flow into the axial groove 791*a*, so that the object can be restricted from staying in the air gap AG.

The thickness of the stator 76, 77 in the radial direction is made thinner as approaching the tip end 762, 776 opposing to the air gap AG, so that the density of the magnetic flux is raised at the tip end 762, 776. Therefore, the magnetic object is easily attracted to the tip end 762, 776. When the magnetic flux disappears, the attracted object is separated from the tip end 762, 776 to the air gap AG. As a result, the separated object easily enters the groove 791*a* located on the lower part, so that the object can be restricted from staying in the air gap AG.

The thickness of the needle 78, that forms the magnetic circuit, in the radial direction is made thinner as approaching the tip end 780 opposing to the air gap AG, so that the density of the magnetic flux is raised at the tip end 780. Therefore, the magnetic object is easily attracted to the tip end 780. When the magnetic flux disappears, the attracted object is separated from the tip end 780 of the needle 78 located on the inner circumference side of the air gap AG. As a result, the separated object easily enters the groove 791*a*, especially located on the lower part, so that the object can be restricted from staying in the air gap AG.

Accordingly, the function of the spacer 79 that restricts the magnetic short circuit from being generated can be maintained. Therefore, the responsivity of the spool 68 is raised when the output shaft 75 integrated with the needle 78 drives the spool 68. Thus, the valve timing can be suitably controlled. In addition, air in the internal chamber 712 that provides a resistance for the movement of the needle 78 is discharged from the aspiration hole 713 in accordance with the movement. Therefore, the spool 68 is smoothly driven by the output shaft 75 integrated with the needle 78, so that the valve timing can be suitably controlled.

The inner circumference face 790 of the spacer 79 has the inclined part 790*a*, 790*b* that inclines outward as approaching the end portion 793, 794 of the spacer 79 in the axis direction. Therefore, when the front stator 76 and the external pipe component 771 of the rear stator 77 are coaxially fitted into the spacer 79 from both sides in the axis direction, the stator 76, 77 is guided by the inclined part 790*a*, 790*b*, so that the fitting can be easily performed. That is, the stator 76, 77 can be easily assembled, so that the productivity and the cost performance of the apparatus 1 can be raised.

The circumferential position of the spacer 79 is arbitrarily set relative to the stator 76, 77. At least one of the axial grooves 791*a* can be located under the air gap AG between the stators 76, 77. Further, the circumferential position of the spacer 79 is arbitrarily set relative to the discharge port 716, because the circumferential groove 791*b* can be secured to communicate with the discharge port 716. Due to such spacer 79, the assembling can be easily performed, so that the productivity and the cost performance of the apparatus 1 can be raised.

(Other Embodiments)

The present invention is not limited to the above embodiment.

Figure 9:
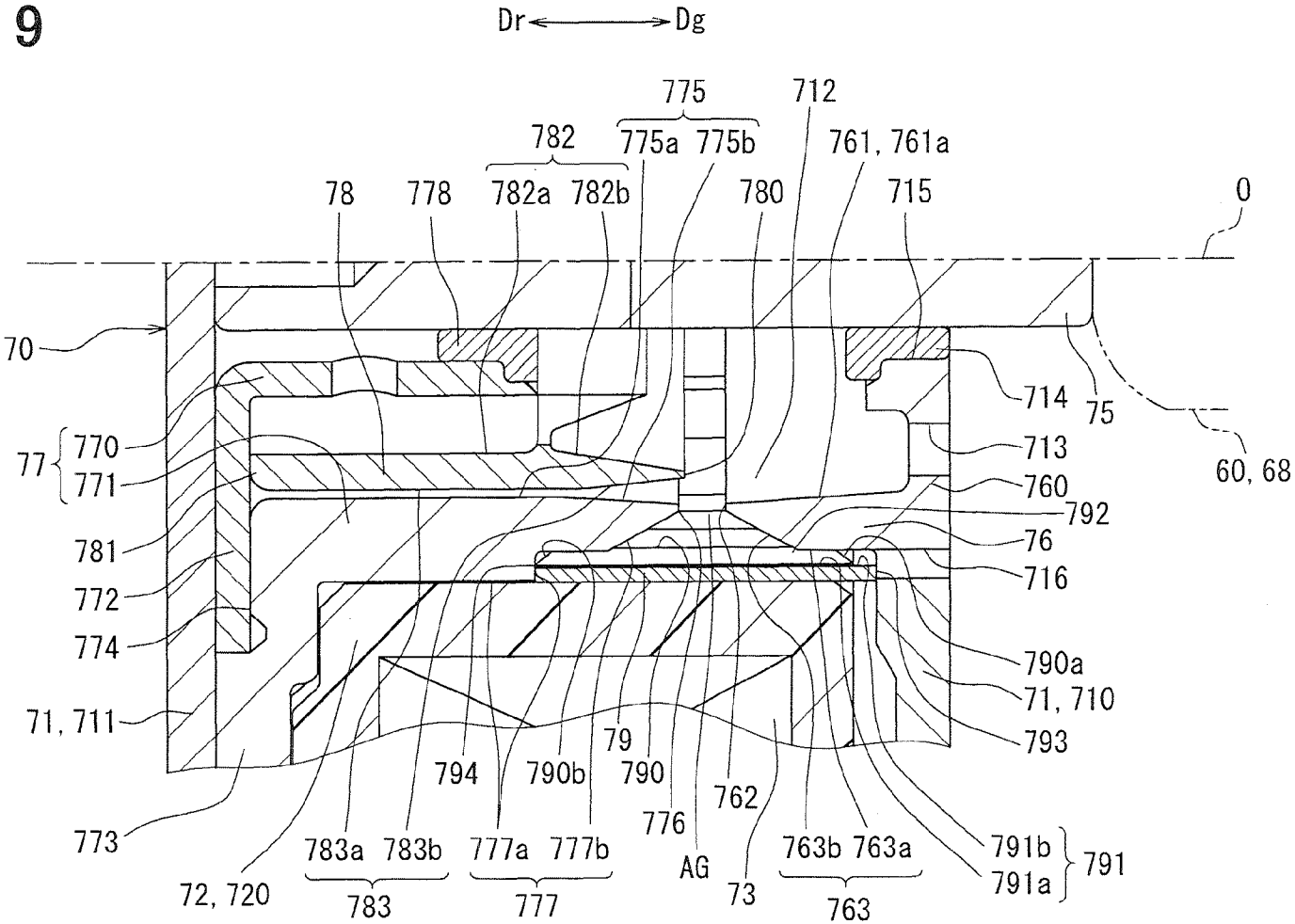
FIG. 9 is a sectional view illustrating a modification example of FIG. 6.

As shown in FIG. 9, an inner circumference tapered part 775*b* that inclines outward in the radial direction as approaching the tip end 776 may be formed on the inner circumference face 775 of the rear stator 77. Further, the inner circumference tapered part 761*a* that inclines outward as approaching the tip end 762 from the bottom 760 may not be formed on the inner circumference face 761 of the front stator 76. Furthermore, a thickness of at least one of the stator 76 and the stator 77 may be made constant, and a thickness of the needle 78 may be made constant.

The casing 71 may not have the aspiration hole 713, or the hole 713 may be formed to be distanced from the opening 668 of the sleeve 66. At least one of the inclined parts 790*a*, 790*b* may be omitted.

Figure 10:
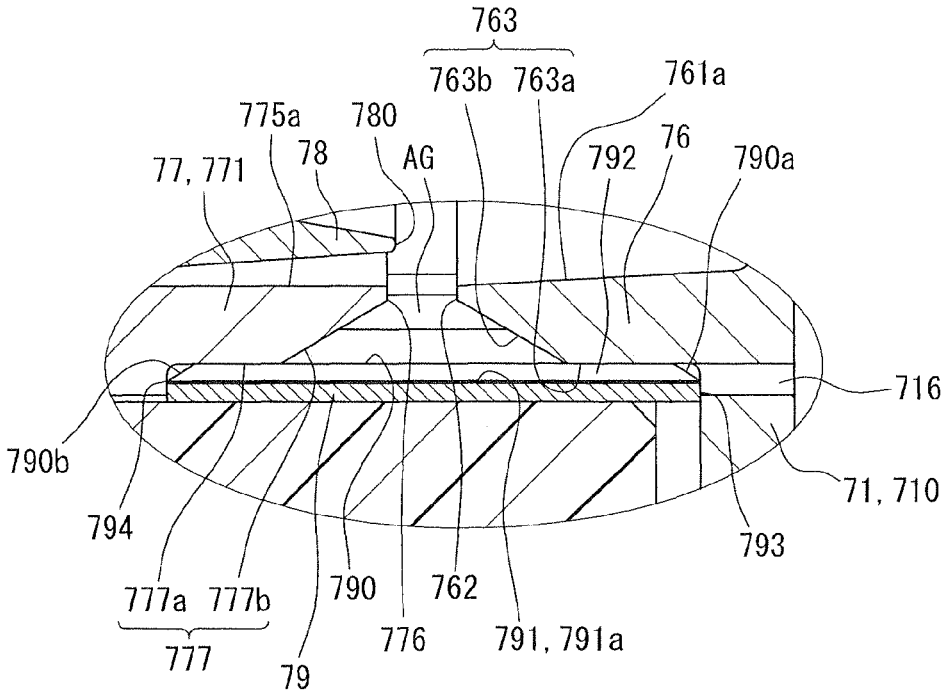
FIG. 10 is a sectional view illustrating a modification example of FIG. 7.

The number of the axial grooves 791*a* may be one. In this case, the axial groove 791*a* is located on the lower side of the air gap AG. Further, as shown in FIG. 10, the circumferential groove 791*b* may be omitted, and the axial groove 791*a* is positioned to oppose to the discharge port 716. Furthermore, a through hole may be defined in the spacer 79, and is opened in the inner circumference face 790 and the end portion 793 so as to form the discharge passage 792.

The nonmagnetic spacer 79 forming the discharge passage 792 may be integrated with the bobbin 720. The control valve 60 may have a construction other than the above description, if the spool 68 is driven in the sleeve 66 by the output shaft 75 of the linear solenoid 70. The valve timing control apparatus 1 may be applied to a device that controls the valve timing of an exhaust valve other than the intake valve, or that controls the both of the exhaust valve and the intake valve.

Various modifications and alternations may be diversely made to the above embodiment without departing from the spirit of the present invention.

What is claimed is:

1. A valve timing control apparatus for controlling a valve timing of a valve configured to be opened and closed by a camshaft in accordance with a torque transmitted from a crankshaft of an internal combustion engine, the valve timing control apparatus comprising:

a housing rotatable with the crankshaft;

a vane rotor rotatable with the camshaft, the vane rotor partitioning an interior of the housing into an advance chamber and a retard chamber in a rotative direction, the vane rotor configured to change a rotation phase relative to the housing to an advance side or a retard side correspondingly when working fluid is supplied into the advance chamber or the retard chamber;

a control valve that controls a flow of the working fluid relative to the advance chamber and the retard chamber through a spool that is linearly movable in a sleeve through which the working fluid passes, the control valve being arranged in a gang rotating element constructed by the vane rotor and the camshaft; and a linear solenoid having an output shaft that linearly reciprocates the spool, a coil that generates a magnetic flux by being supplied with electricity, a casing defining an internal chamber into which the working fluid flows from the sleeve, and a discharge port from which the working fluid is discharged out of the internal chamber, a needle that reciprocates integrally with the output shaft in the internal chamber, a pair of cylindrical stators opposing with each other through an air gap in an axis direction in the internal chamber, the pair of stators and the needle forming a magnetic circuit through which the magnetic flux passes so as to drive the needle to reciprocate on an inner circumference side of the pair of stators in a radial direction, and a cylindrical spacer fitting with an outer circumference side of the pair of stators in the internal chamber so as to restrict a short circuit from being generated in the magnetic circuit between the pair of stators, the air gap being located on an inner circumference side of the spacer, wherein the spacer defines a discharge passage that connects the air gap to the discharge port of the casing.

2. The valve timing control apparatus according to claim 1, wherein the discharge passage defined by the spacer is located under the air gap.

3. The valve timing control apparatus according to claim 1, wherein the spacer has an inner circumference face that fits with the pair of stators, a discharge groove is defined to be open on the inner circumference face of the spacer, and the discharge passage is defined by the discharge groove.

4. The valve timing control apparatus according to claim 3, wherein the discharge groove has three or more axial grooves arranged with constant intervals around a center axis line of the spacer in a horizontal direction, and each of the axial grooves extends along the center axis line from the outer circumference side of the air gap.

5. The valve timing control apparatus according to claim 4, wherein the discharge groove further has a circumferential groove extending around the center axis line of the spacer, and the circumferential groove communicates with the axial grooves and the discharge port of the casing in the axis direction.

6. The valve timing control apparatus according to claim 1, wherein at least one of the pair of stators has a tip end opposing to the air gap, and an inner circumference face of the at least one of the pair of stators has a tapered part that is inclined to the outer circumference side as approaching the tip end.

7. The valve timing control apparatus according to claim 1, wherein at least one of the pair of stators has a tip end opposing to the air gap, and a thickness of the at least one of the pair of stators becomes thinner as approaching the tip end.

8. The valve timing control apparatus according to claim 1, wherein the needle has a tip end that is located on an inner circumference side of the air gap when no electricity is supplied to the coil, and the needle has a cylindrical shape, and a thickness of the needle becomes thinner as approaching the tip end.

9. The valve timing control apparatus according to claim 1, wherein the sleeve has an opening communicating with an inside of the sleeve through which the working fluid passes, the casing has an aspiration hole opposing to the opening of the sleeve, and the internal chamber of the casing is opened to an atmospheric air through the aspiration hole.

10. The valve timing control apparatus according to claim 1, wherein the spacer has an inner circumference face that coaxially fits with the pair of stators, and the inner circumference face of the spacer has an inclined part that is inclined toward an outer circumference side of the spacer as approaching an end of the spacer in the axis direction.

* * * * *